United States Patent [19]

Finley

[11] Patent Number: 4,788,950

[45] Date of Patent: Dec. 6, 1988

[54] QUICK RELEASE VALVE COVER

[76] Inventor: Ron Finley, 191 Fourth Ave., Wendell, Id. 83355

[21] Appl. No.: 123,241

[22] Filed: Nov. 20, 1987

[51] Int. Cl.[4] ..... F02F 7/00

[52] U.S. Cl. ..... 123/195 C; 123/90.38; 123/198 E

[58] Field of Search ..... 123/195 C, 90.37, 90.38, 123/198 E, 196 R

[56] References Cited

U.S. PATENT DOCUMENTS

| | | | |
|---|---|---|---|
| 3,396,712 | 6/1968 | Sakraida | 123/198 E |
| 3,568,799 | 3/1971 | Bivins | 123/196 R |
| 4,308,828 | 1/1982 | Kinsel | 123/90.38 |
| 4,388,898 | 6/1983 | Larson | 123/90.38 |
| 4,538,560 | 9/1985 | Alden | 123/195 C |

FOREIGN PATENT DOCUMENTS

| | | | |
|---|---|---|---|
| 363657 | 6/1923 | Fed. Rep. of Germany | 123/195 C |

*Primary Examiner*—E. Rollins Cross
*Attorney, Agent, or Firm*—Frank J. Dykas

[57] ABSTRACT

A quick release valve cover for internal combustion engines, having housing 11 attachable to the cylinder head of the internal combustion engine, and upper cap 12. Hinge arms 16 are provided for attachment to the top of the upper cap 12 at hinge supports 25. Hinge arms 16 are adapted for engagement with the cam of locking arms 20 and hinge sections 19 and the slots of hinge sections 19. Elastomeric "O"-ring seal 23 is disposed within seal groove 22 of housing 11 to provide a seal between upper cap 12 and lower housing 11.

3 Claims, 4 Drawing Sheets

QUICK RELEASE VALVE COVER

BACKGROUND OF THE INVENTION

1. Technical Field

The present invention relates to a removable and sealable cover for machinery compartments containing lubricants and more particularly to a removable and sealable valve cover for the cylinder head of an internal combustion engine.

2. Background Art

Removable covers for machinery compartments enclosing moving lubricated parts are quite common. These covers are usually flanged and sealed by a soft gasket of suitable composition and secured in place by a series of bolts or other fasteners. Removal of the cover usually requires removal of the fasteners and often replacement of the gasket, which may be damaged by the operation. U.S. Pat. Nos. 2,724,378 and 3,396,712 disclose similar removable and sealable covers for an internal combustion engine cylinder head which differ principally in the method of sealing the cover.

U.S. Pat. No. 2,724,378, provides a valve cover with a removable top for safety reasons. The removable top is designed to automatically open to relieve high gas pressures resulting from explosions of unburned fuel which has leaked from between the valve stem and valve guides into the valve chamber. U.S. Pat. No. 3,396,712, provides an oil seal arrangement to prevent leakage between the cover and the valve cover housing.

Each of the above inventions describe a relatively complicated system consisting of many parts including pins, springs, hinges, rivets and seals which are familiar to those skilled in the art and which possess potential points of failure. The other patents are representative of what is in the prior art. Because these systems vary in construction from each other it is difficult to evaluate their effectiveness. Although it may be assumed that they function in the alleged manner, it is reasonable to assume that there is a continuing need for improvement in such removable and sealable covers. Through detailed analysis and testing it appears that the present invention contributes substantially to such needed improvements, particularly for removability, sealability and reliability.

A particular problem with each of these designs is that they are not suitable for use in automotive or power boat racing applications. In drag racing or stock car racing applications, it is not uncommon to stress the engine parts to the extent that the cylinder valves need readjusting after each and every engine run or race. The same is true with power boat racing. As a result, race mechanics will oftentimes remove cylinder head valve covers several times during the course of a single day of racing. The reason for removing the cylinder head valve covers is to gain access to the valve adjusting mechanisms linkage, be it push rod and rocker arm assemblies or overhead cam shafts, in order to adjust the valve clearances.

When the standard cylinder head valve cover is removed, a certain quantity of oil trapped on top of the cylinder head is lost, and usually spilled onto other engine parts including hot exhaust manifolds. Additionally, the valve cover gaskets normally require replacement each time the cylinder head valve cover is removed. This results in added effort, expense, and oftentimes a smokey, oily mess on the engine.

The removable covers of U.S. Pat. Nos. 2,724,378 and 3,396,712, solve the problem of the loss of oil, however, both designs do not provide for adequate lateral access to the valve adjustment linkage to adjust the valves.

The valve adjusting mechanisms are of two general types, the first is a rocker arm and push rod assembly, and the second is an overhead cam. In both cases, current engine designs provide for very compact valve covers which have to be removed more or less vertically up from the cylinder head to clear the valve adjusting mechanism. As a result, the designs of U.S. Pat. Nos. 2,724,378 and 3,396,712 cannot be modified by lowering the cylinder head housing and extending the height of the top cap to allow for lateral access to the valve adjusting mechanisms. The design of the hinges on said patents is such that the top caps would not clear the valve adjusting mechanism when a person attempted to open the cover. The hinging mechanism must be such that the top cap can be removed more or less vertically prior to being pivoted out of the way.

What is needed is a quick release cylinder head valve cover which, when open, will still not spill or allow the loss of oil, yet, will still allow sufficient lateral access to the valve adjusting mechanisms of the engine.

DISCLOSURE OF INVENTION

Accordingly, it is an object of this invention to provide a new cylinder head quick release valve cover with a cylinder head housing open at the top and the bottom for removable attachment to the top of the cylinder head and which extends upward from the cylinder head only far enough to prevent the loss of oil when the top cap of the quick release valve cover is opened, yet not so far upward so as to prevent lateral access to the valve adjustment mechanisms of the engine. Another object of the invention is to provide a locking mechanism for holding an upper cap against the lower housing which can be closed and released without the use of hand tools to unfasten or pry open fasteners or clamps.

Other objects of this invention are to provide a new and improved removable and sealable system for covering machinery compartments enclosing moving lubricated parts which has all of the advantages of the prior art and none of the disadvantages; to provide a system which is easily attachable and may be used conveniently on a wide variety of large and small internal combustion engines or other machinery; to provide a system which may be easily and efficiently manufactured and which may be assembled and used in a rapid and easily understood manner; to provide a system which will prove to be of a durable and rugged construction under extended use situations; to provide a system which may be of low cost of manufacture with regard to both materials and labor and thus may be sold to the consuming public at low and reasonable prices; to provide a system which will withstand frequent and repetitive operation under severe conditions without failure.

BEST MODE FOR CARRYING OUT INVENTION

Figure 1:
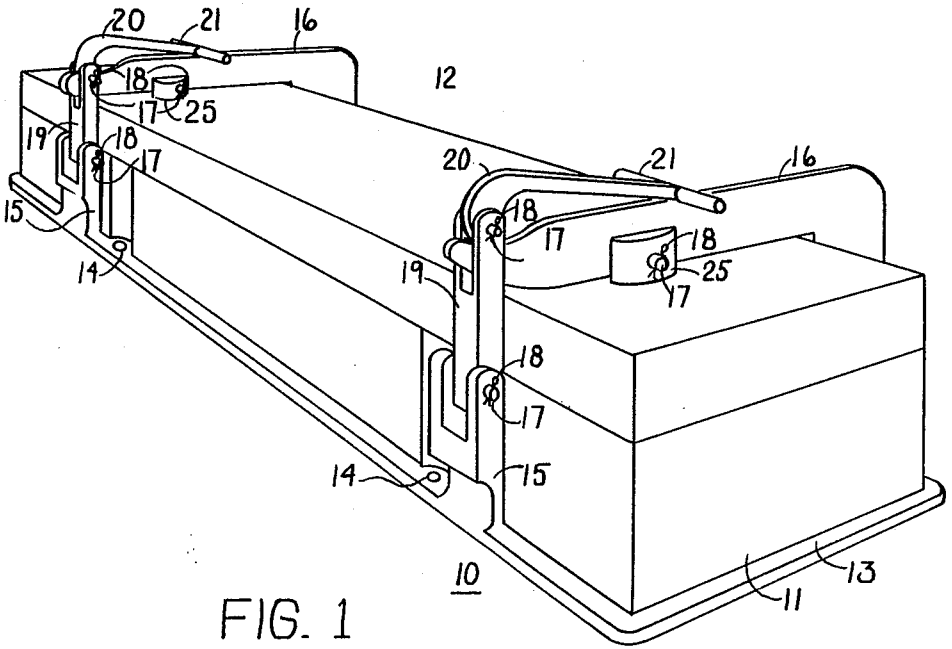
FIG. 1 is a perspective view of the valve cover closed.
Figure 2:
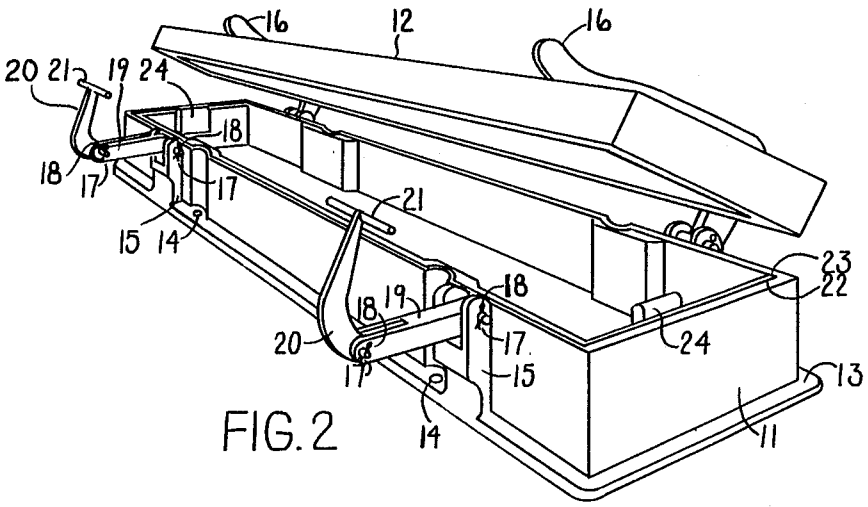
FIG. 2 is a perspective view of the valve cover open.

With reference now to the drawings and in particular to FIGS. 1 and 2 thereof, a new and improved removable and sealable valve cover for cylinder heads of internal combustion engines embodying the principles and concepts of the present invention and generally designated by the reference numeral 10 is disclosed. The removable and sealable valve cover 10 is designed for portable use and is divided into a lower housing 11 separably attached in a way to be described to an upper cap 12. Lower housing 11 consists of a molded aluminum rectangularly shaped cylinder head housing open at the top and bottom and removably attachable through base flange 13 to the cylinder head of an internal combustion engine in a conventional and understood way by use of existing multiple mounting bolt holes 14 and an existing sealing gasket which is not shown.

The walls of lower housing 11 extend upward from the top of the cylinder head. They are designed to encase valve activation and adjustment mechanism of the internal combustion engine, not shown, which may be a rocker arm and push rod assemblies or an overhead cam assembly. Lower housing 11 is sized to conform to the shape of the sealing surface of the particular cylinder head, and of a height which is sufficient to hold or otherwise keep entrained or pooled engine oil from dripping off of the top of the cylinder head surface. Yet still low enough to allow lateral access to the valve adjusting means of the particular valve activation assembly used for that particular internal combustion engine.

On each longer side of and molded oppositely and symmetrically into and forming an integral part of lower housing 11 are multiple hinge flanges 15. On one of the longer sides of lower housing 11 multiple identical hinge arms 16 are detachably and rotatably connected at one end to hinge flanges 15 in an understood way by means of pins 17 removably secured by cotter pins 18 in a known manner.

On the other longer side of lower housing 11 multiple, identical metal hinge sections 19 are detachably and rotatably connected at one end to hinge flanges 15 in an understood way by means of pins 17 removably secured by cotter pins 8 in a known manner. Each of hinge sections 19 are detachably and rotatably connected at the other end in an understood way to a metal locking arm 20 by means of pins 17 removably secured by cotter pins 18. Each locking arm 20 has a suitable handgrip 21 mechanically attached by welding or molding or other known means to the other end of the locking arm 20.

Figure 4:
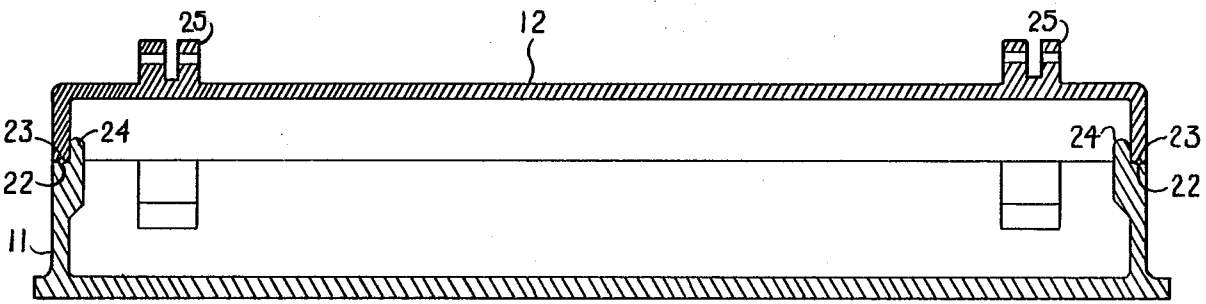
FIG. 4 is a sectional side view of the valve cover.

The top surface of lower housing 11 as shown in FIGS. 2 and 4, contains a continuous seal groove 22 with a rectangular cross section and whose path is slightly rounded at each corner of lower housing 11, to permit the removable placing of continuous "O"-ring seal 23 which serves as a sealant between lower housing 11 and upper cap 12 when these parts are in contact. "O"-ring seal 23 is composed of suitable known elastomeric material selected to withstand temperatures and pressures customarily encountered in the operation of internal combustion engines as well as to resist the deleterious effects of the oils and fuels normally employed. The internal dimensions of the continuous seal groove 22 and the external dimensions of elastomeric "O"-ring seal 23 are selected to provide optimum sealing qualities using conventional and well known procedures and form no part of this invention.

Upper cap 12 consists of a rectangular shaped molded aluminum cover which is shaped in a well known manner to conform to the interior and external rectangular dimensions of lower housing 11.

Figure 3:
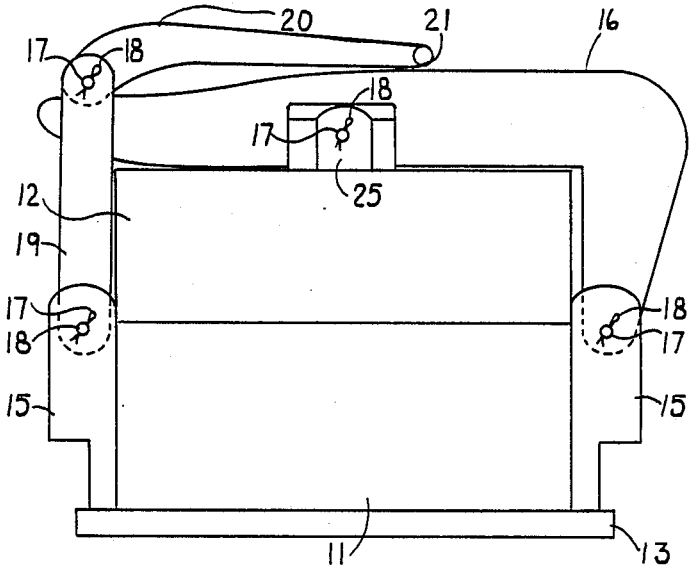
FIG. 3 is an end view of the valve cover closed.

As shown in FIGS. 1, 2 and 3, hinge flanges 15 extend upward from the sealing surface of lower housing 11 and serve to laterally align upper cap 12 when upper cap 12 is lowered onto lower housing 11 for closure. As can be seen in FIGS. 1 and 3, upper cap 12 exterior demensions are of conforming size to lower housing 11 and as a result, the upwardly extending portions of hinge flanges 15 serve to laterally align upper cap 12 with lower housing 11.

Longitudinal alignment is accomplished by means of end tabs 24 which are interior to the end walls of lower housing 11 as shown in FIGS. 2 and 4. End tabs 24 serve as guides to position and hold upper cap 12 in the correct longitudinal position when upper cap 12 is lowered for closure onto lower housing 11.

On the top surface of upper cap 12, as seen in FIGS. 1, 3 and 4, and midway between the front and rear edges and along the longitudinal axis of upper cap 12, are multiple hinge supports 25 which form an integral and permanent part of upper cap 12 and to which multiple hinge arms 16 are rotatably and detachably connected by means of removable pins 17 secured by removable cotter pins 18 in an understood manner, as shown in FIGS. 1 and 3.

The axis of connection between multiple hinge supports 25 and multiple hinge arms 16, as shown in FIG. 3, are selected in a known manner to allow a clearance between the top surface of upper cap 12 and the lower surfaces of multiple hinge arms 16 when lower housing 11 and upper cap 12 are in closed contact. This clearance permits a rocking motion of upper cap 12 when raising or lowering upper cap 12 so as to allow clearance between upper cap 12 and the enclosed valve adjusting mechanism. Additionally, this adjustability of upper cap 12 when engaging and disengaging the two surfaces minimizes abrasion and distortion of continuous "O"-ring seal 23 and enables exertion of an essentially equal closing and holding force along the entire continuous sealing surface between lower housing 11 and upper cap 12.

The closing and holding force is applied by the lever action of multiple hinge locking arms 20 which have cam shaped surfaces, as shown in FIG. 3, on the ends rotatably and removably attached to multiple hinge sections 19. These cam shaped surfaces bear against the upper surfaces of multiple hinge arms 16 when locking arms 20 and hinge sections 16 are inserted into the slots defined in hinge sections 19, as shown in FIGS. 1 and 3. Locking arms 20 and hinge arms 16 are rotatably engaged and disengaged in a known and understood manner during the opening and closing of upper cap 12 and lower housing 11. The cam shape of the ends of locking arms 20 and the dimensions of meeting surfaces between locking arms 20 and hinge arms 16 are chosen in a well known manner to cause suitable vertical travel of upper cap 12 when seating and sealing against the upper surface of lower housing 11 Locking arms 20 may be secured in the closed position in a known and understood manner, not shown here, to prevent accidental release during operation of the internal combustion engine.

The foregoing is considered as illustrative only of the principles of the invention. Optimal dimensional relationships for the parts of the invention, to include variations in size, shape, materials, function and manner of operation, assembly and use are deemed readily apparent and obvious to one skilled in the art. All suitable modifications and equivalents may be resorted to, falling within the scope of the invention.

What I claim is:

1. A quick release valve cover for the cylinder head of an internal combustion engine which comprises:

cylinder head housing means, having openings at the top and bottom for circumferentially enclosing the upper perimeter of a cylinder head, said housing being sealably and removably attached to and extending upwardly from the perimeter of said cylinder head a distance only sufficient to prevent leakage of entrapped oil and low enough to allow lateral access to valves adjusting mechanisms located atop the cylinder head;

an upper cap operably attached to said cylinder head housing means for covering the valve adjusting mechanism located atop of the cylinder head, and whose external contiguous surfaces conform dimensionally with those of said cylinder head housing means;

housing sealing means operably disposed between said cylinder head housing means and the upper cap for sealing the joint between the housing means and upper cap to prevent the leakage of oil;

upper cap holding and locking means for securing said upper cap to the housing means.

2. The apparatus of claim 1 wherein said sealing means further comprises:

a continuous "O"-ring sealing groove disposed upon and within the upper surface of the cylinder head housing means for containing a continuous "O"-ring seal for sealing the joint between the housing means and the upper cap;

an elastomeric "O"-ring disposed with said sealing groove for forming a resilient elastomeric seal between said housing and upper cap.

3. A quick release valve cover for the cylinder head of an internal combustion engine which comprises:

cylinder head housing means, having openings at the top and bottom for circumferentially enclosing the upper perimeter of a cylinder head, said housing being sealably and removably attached to and extending upwardly from the perimeter of said cylinder head a distance only sufficient to prevent leakage of entrapped oil and low enough to allow lateral access to valves adjusting mechanisms located atop the cylinder head, said cylinder head housing means being of generally rectangular shape and having first and second longer and opposing sides;

a plurality of hinge flanges attached to the first and second longer sides in opposed relationship;

an upper cap for covering the valve adjusting mechanism located atop of the cylinder head, whose external contiguous surfaces conform dimensionally to those of said cylinder head housing means;

a plurality of hinge supports attached to the top of the upper cap, each disposed in the lateral line defined by the pairs of opposing hinge flanges;

a plurality of hinge arms each pivotally attached to a hinge flange on a first longer side and attached to the corresponding hinge support atop the upper cap, having an extended portion adapted for extension along the line defined by the pair of opposing hinge flanges to a location above the hinge flange of the second longer side, and adapted for insertion into a hinge section slot and further adapted for interaction with the cam of a locking arm;

a plurality of hinge sections pivotally attached at one end to the opposing hinge flanges on the second longer side, and having slots at their other ends for receiving the extended portion of the hinge arms;

a plurality of locking arms, having cams at one end, said locking arms pivotally attached at their camed end to the slotted end of the hinge sections for insertion of the cam into the slots by pivotal rotation of the locking arms;

a continuous "O"-ring sealing groove disposed upon and within the upper surface of the cylinder head housing means for containing a continuous "O"-ring for sealing the joint between the housing means and the upper cap;

an elastomeric "O"-ring disposed within said sealing grove for forming a resilient elastomeric seal between said housing and upper cap.

* * * * *